US006520876B1

(12) United States Patent
Eastman, II

(10) Patent No.: US 6,520,876 B1
(45) Date of Patent: Feb. 18, 2003

(54) REINFORCED ARROW SHAFT INCLUDING INTEGRAL FABRIC SLEEVE, METHOD OF MAKING SAME, AND ARROW WHICH IS PRODUCED THEREWITH

(76) Inventor: Robert Eastman, II, c/o Game Tracker, Inc., P.O. Box 380, Flushing, MI (US) 48433

( * ) Notice: Subject to any disclaimer, the term of this patent is extended or adjusted under 35 U.S.C. 154(b) by 0 days.

(21) Appl. No.: 09/685,233

(22) Filed: Oct. 10, 2000

(51) Int. Cl.[7] ..... F42B 6/04
(52) U.S. Cl. ..... 473/578; 428/36.91
(58) Field of Search ..... 473/578; 428/36.1, 428/36.3, 36.91

(56) References Cited

U.S. PATENT DOCUMENTS

| | | | | | |
|---|---|---|---|---|---|
| 2,694,661 | A | * | 11/1954 | Meyer | |
| 4,489,949 | A | | 12/1984 | Taylor et al. | |
| 4,533,146 | A | | 8/1985 | Schaar | |
| 4,534,568 | A | | 8/1985 | Tone | |
| 4,706,965 | A | * | 11/1987 | Schaar | |
| 4,795,165 | A | | 1/1989 | Tehan | |
| 4,900,038 | A | | 2/1990 | Czetto et al. | |
| 5,090,149 | A | | 2/1992 | Muk Kim | |
| 5,295,692 | A | * | 3/1994 | Wright | |
| 5,324,558 | A | * | 6/1994 | Muto et al. | 428/36.91 |
| 5,385,767 | A | * | 1/1995 | Noguchi | 428/36.91 |
| 5,443,272 | A | * | 8/1995 | Vincent | |
| 5,538,769 | A | * | 7/1996 | Sandman | 428/36.3 |
| 5,686,155 | A | * | 11/1997 | Suzue et al. | 428/36.1 X |
| 5,721,030 | A | * | 2/1998 | Okada | 428/36.3 |
| 5,964,056 | A | * | 10/1999 | Grice | 428/36.3 X |
| 5,968,621 | A | * | 10/1999 | Okada | 428/36.3 |
| 5,997,970 | A | * | 12/1999 | You | 428/36.3 X |
| 6,129,962 | A | * | 10/2000 | Quigley et al. | 428/36.1 |
| 6,179,736 | B1 | * | 1/2001 | Thurber | 473/578 |
| 6,251,036 | B1 | * | 6/2001 | Wu et al. | 473/578 |

* cited by examiner

*Primary Examiner*—John A. Ricci
(74) *Attorney, Agent, or Firm*—Carrier, Blackman & Associates, P.C.; William D. Blackman; Joseph P. Carrier

(57) ABSTRACT

A reinforced archery arrow shaft includes a tubular core, with an attached fabric sleeve covering the core. The core may include carbon therein. The sleeve is formed from a fabric material, which is wrapped around and affixed to the core. Preferably, the sleeve fabric carries a decorative design or pattern on the exterior surface thereof. In a method of making an arrow, a piece of fabric is placed covering a hollow tubular core, and is affixed thereto. Then, a resin or protective composition, associated with the fabric material, is cured to adhere the fabric to the core. The resin may be impregnated into the fabric prior to its placement on the core, or alternatively, may be applied to the fabric by conventional methods such as spraying, dipping, brushing, or powder coating. The shaft may be treated to make the exterior surface smooth after curing. Optionally, accessories may be attached to the arrow shaft to form an arrow.

2 Claims, 3 Drawing Sheets

REINFORCED ARROW SHAFT INCLUDING INTEGRAL FABRIC SLEEVE, METHOD OF MAKING SAME, AND ARROW WHICH IS PRODUCED THEREWITH

BACKGROUND OF THE INVENTION

1. Field of the Invention

The present invention relates to a reinforced archery arrow shaft, including a hollow tubular core having an integral fabric sleeve in covering relation thereon. More particularly, the present invention relates to a reinforced arrow shaft including a hollow tubular core, a woven or non-woven fabric sleeve surrounding the core and integrally attached thereto, and an adhesive resin material impregnated into the sleeve. In a preferred embodiment, the present invention relates to an arrow shaft of the type described, in which a decoration or pattern is applied to the fabric which forms the sleeve before it is placed in covering relation on the core.

2. Description of the Background Art

Many different types of arrows are known for use in hunting and in sport archery. Many different arrows may be found in class 473, subclass 578, and the subclasses immediately following.

Examples of some of the issued patents disclosing archery arrows include U.S. Pat. Nos. 4,489,949, 4,533,146, 4,534,568, 4,795,165, and 4,900,038. It has become fairly standardized for archery arrows to be made using a graphite or other carbon-containing material in the construction of the hollow arrow shaft. Tubular metal shafts have, alternatively, also been used.

However, there are some drawbacks with the use of carbon composite arrow shafts, including the tendency of some of the arrow shafts to become slightly warped during curing thereof, in the manufacturing process, leading to scrap.

Another limitation on conventional carbon composite arrow shafts is that, although they are adequate for normal usage, under heavy-duty use and in extreme conditions, such arrow shafts may fail.

Hunting arrows are placed under significant stresses during the placement of the arrows in bows, during release, and during the entry of the arrow into a target. If these types of stresses become more than the arrow shaft can withstand, carbon composite arrows may crack, break or splinter, thus necessitating the expense of purchasing replacement arrows.

Although such arrow failure is relatively uncommon and exceptional, improvements in arrow technology are always welcome. Experienced hunters and sportsmen often seek out premium quality products, which are the most reliable and durable available.

Another limitation of the known arrows is that, although it has been known to place a design or pattern on the exterior surface of arrow shafts, such as, e.g., a camouflage pattern, this is normally done using paint on the exterior surface of the arrow shaft, or, in the case of metal shafts, anodizing the metal in selected areas to create a pattern or design thereon. After repeated use, it is common for such paint or anodized material to be worn off, leading to deterioration of the arrow's appearance.

In the fishing art, which is a different technical area from archery, it has been known to place an external fabric sleeve on a fishing rod section, and to then cover the fabric sleeve with a transparent coating. U.S. Pat. No. 5,090,149 to Muk Kim discloses a hollow, decorated pole for a fishing rod, in which a flexible rectangular wrapper, with a predetermined design imprinted thereon, is positioned around the outer surface of the shaft, and is subsequently covered with a transparent coating.

While the fishing rod of Muk Kim is useful for fishermen and for the fishing industry, the teaching of this reference is not directed to any technical area outside of the fishing art.

Although the known devices have some utility for their intended purposes, a need still exists in the art for improved archery arrow shafts.

A need exists for an arrow shaft having a strengthened and reinforced tubular core.

A need also exists for decorated archery arrows, which carry an image or pattern thereon, in which the pattern is durable and long-lasting. Preferably, such an image or pattern could be integrally bonded to an arrow shaft. Ideally, such a decorated arrow would include a sleeve, to cover and coat an inner core, in order to provide added stability and strength to the arrow assembly.

SUMMARY OF THE INVENTION

The present invention provides an improved archery arrow shaft, including a tubular core, with a fabric sleeve attached to, covering and surrounding the core.

The sleeve may be formed from a rectangular piece of woven or non-woven fabric material, which has been wrapped around and affixed to the core.

Alternatively, the sleeve may be formed from a thin, continuous strip of fabric material, which is wrapped spirally and in covering relation around the arrow core.

In a preferred embodiment of the invention, the sleeve is formed from a patterned fabric, which has been imprinted with a decorative design or pattern on the exterior surface thereof.

The present invention also encompasses a method of making an arrow shaft having a fabric-reinforced core. In practicing the method according to the invention, first, a piece of woven or non-woven fabric material is placed in covering relation on a hollow tubular core, and is affixed thereto.

Then, in the method of the present invention, a resin on the fabric material is cured to adhere the fabric to the core. The resin may be impregnated into the fabric prior to its placement on the core, or alternatively, may be applied to the fabric by conventional methods such as spraying, dipping, brushing, or powder coating, after the fabric is applied to the core.

The resin may be applied as a liquid and air-dried, or alternatively, may be a thermosetting resin, which is cured by heating.

In a variation of the basic method, the fabric sleeve may be affixed to the core, by resin which is incorporated in the interstices of the fabric, when the resin is cured.

In a particularly preferred embodiment of the invention, the fabric material is pre-printed or otherwise inscribed with a design or pattern before being applied to the core.

Accordingly, it is an object of the present invention to provide a fabric-reinforced archery arrow shaft, and a method of producing such an arrow shaft.

It is another object of the present invention to provide a fiber-reinforced archery arrow shaft which is resistant to cracking, warping, splitting and/or breakage of a core thereof.

It is a further object of the present invention to provide an improved archery arrow shaft which bears a durable decoration, design or pattern thereon.

It is yet a further object of the invention to provide an arrow which includes a fabric-reinforced shaft.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Figure 1:
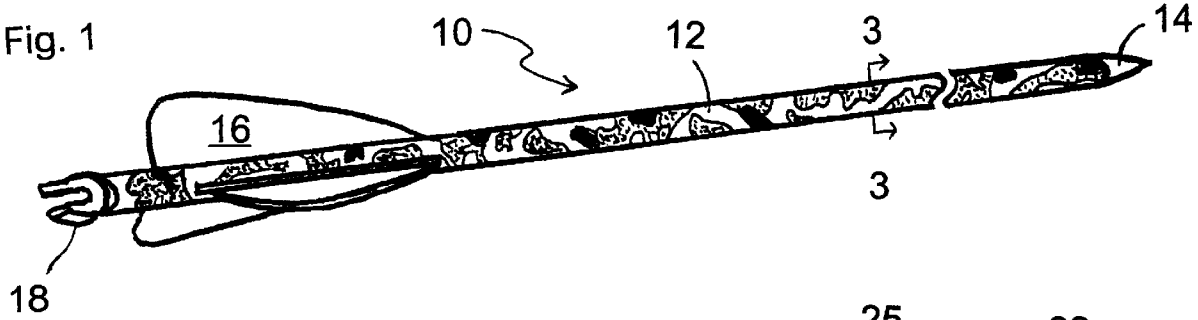
FIG. 1 is a perspective view of an archery arrow including a reinforced arrow shaft according to a preferred embodiment of the invention.
Figure 2:
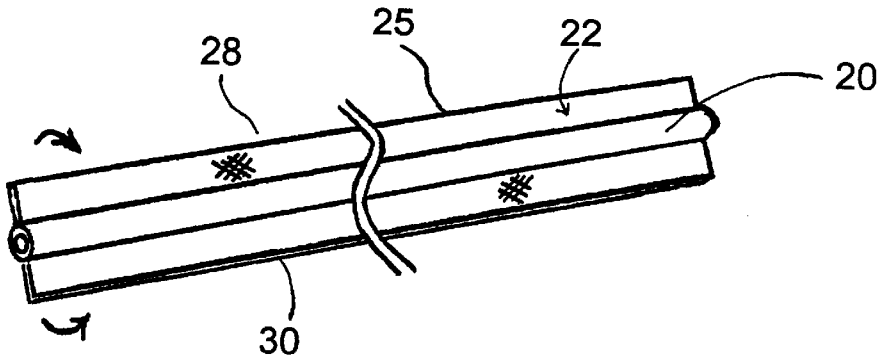
FIG. 2 is a perspective view of a the tubular core which is a component of the arrow shaft of FIG. 1, also showing a rectangular section of fabric material for forming a sleeve around the core in a first embodiment.
Figure 3:
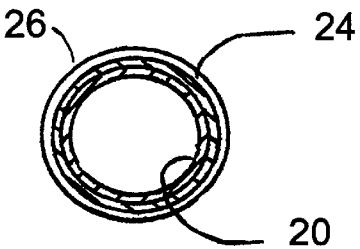
FIG. 3 is a cross-sectional view of the arrow shaft of FIG. 1, taken along the line 3—3 thereof.

Referring now to FIGS. 1–3 of the drawings, a reinforced arrow, according to a first embodiment of the invention, is shown generally at 10. The arrow 10 includes a reinforced arrow shaft 12, and a number of auxiliary accessories attached to the shaft including a tip or arrow head 14, fletching 16, and a nock 18.

The shaft 12 includes a hollow tubular core 20, which can be made entirely out of a lightweight carbon composite material. Alternatively, the core 20 may be formed from fiberglass, from metal tubing such as aluminum or an aluminum alloy, of from a laminated combination of fiberglass and a carbon-based material.

The core may have a substantially constant and continuous diameter throughout the length thereof. A constant diameter is most preferred in the practice of the present invention. Alternatively, one end of the core 20 may have a larger diameter than the opposite end.

Figure 4:
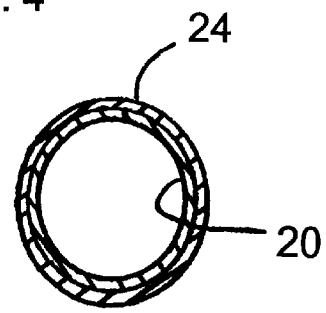
FIG. 4 is a cross-sectional view of an alternative version of the arrow shaft of FIG. 1, taken along the line 3—3 thereof.

The shaft 12 is reinforced by first, wrapping a piece of fabric material 22 around the core 20 to form a sleeve 24 (FIGS. 3, 4), and then curing a resin composition associated with the fabric material, to form a transparent coating 26 thereon.

In the embodiment of FIG. 2, the fabric material 22 is formed in the shape of a narrow rectangular sheet 25, which is oriented with its opposed side edges 28, 30 oriented parallel to the central longitudinal axis of the core 20, and the sheet is then wrapped closely around the core to form the sleeve 24. Where the sleeve 24 is formed in this way, the sheet 25 may be wrapped around the core 20 so that its opposed side edges 28, 30 abut and touch one another. Alternatively, the strip 25 may be wrapped around the core 20 so that a first side edge 28 covers and overlaps a second side edge 30.

Figure 5:
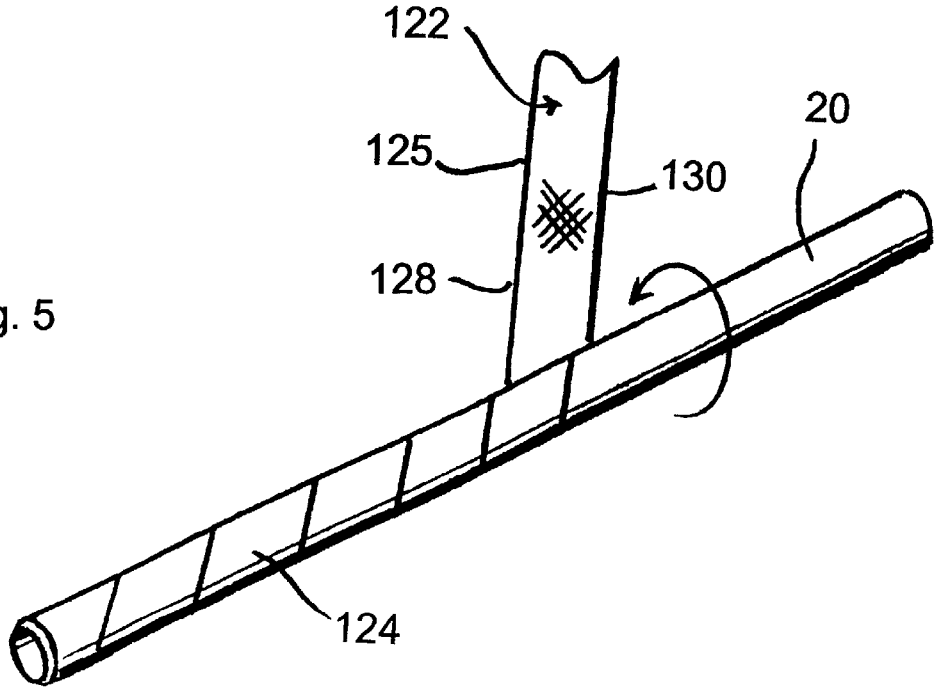
FIG. 5 is a perspective view of a tubular core which is a component of the arrow of FIG. 1, also showing a thin strip of fabric material for forming a sleeve around the core, the fabric material being wrapped spirally and in covering relation around the core in a second embodiment.

Alternatively, and as shown in FIG. 5, a sleeve 124 may be formed by wrapping a thin, elongated strip 125 of a fabric material 122 in spiral fashion around the core 20. Where the sleeve 124 is formed in this way, the strip 125 may be wrapped around the core 20 so that its opposed side edges 128, 130 abut and touch one another. Alternatively, the strip 122 may be wrapped around the core 20 so that a first side edge 128 covers and overlaps a second side edge 130.

The fabric material 22 may be a woven or a nonwoven fabric. Knit fabrics are considered to be woven fabrics in the practice of the invention.

The material of the fabric may be selected from the group consisting of nylon, polyester, cotton, KEVLAR™, or other material known in the art.

In a preferred embodiment of the invention, the sleeve is formed from a patterned fabric, which has been imprinted or otherwise inscribed with a decorative design or pattern on the exterior surface thereof. In the embodiment of FIG. 1, a camouflage pattern is shown on the sleeve 24.

The resin or protective composition may be applied to the exterior of the fabric sleeve 24 to form a transparent protective outer layer 26, as shown in FIG. 3.

Alternatively, the resin or protective composition may be impregnated into the interstices of the fabric material 22, 122 so that the resin is distributed through the sleeve 24. In one embodiment, the resin in the fabric 22, 122 bonds the fabric to the core 20 when the resin is cured.

By way of example and not limitation, dipping the fabric into a liquid solution, suspension or emulsion of uncured resin is one way of distributing the resin into the interstices of the fabric. Alternatively, this may be accomplished by spraying a liquid under pressure into the fabric, where the liquid contains uncured resin.

Figure 6:
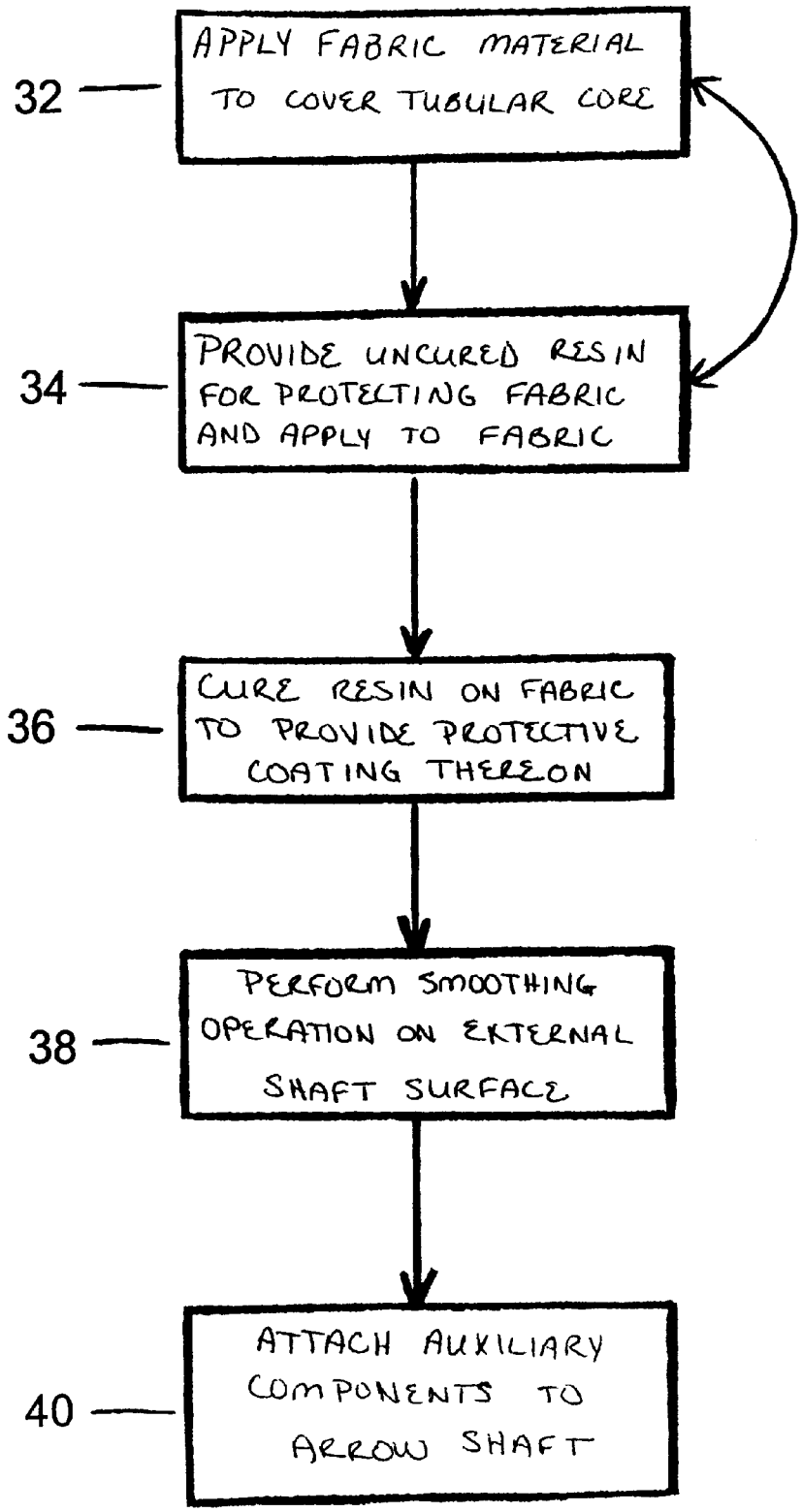
FIG. 6 is a graphical flow chart showing a sequence of steps in a preferred method according to the invention.

The present invention also encompasses a method of making a fabric-reinforced arrow shaft 12. In practicing the method according to the invention, a piece of woven or non-woven fabric material 22 is placed in covering relation on a hollow tubular core 20, and is affixed thereto. This method step is shown at 32 in FIG. 6.

As previously noted, in a particularly preferred embodiment of the invention, the fabric material 22, 122 is preprinted or otherwise inscribed with a design or pattern before being applied to the core 20. This also applies to the method hereof.

Another step in the method is to provide an uncured resin for protecting the fabric, and to apply it to the fabric material 22. This step is shown at 34 in FIG. 6, and as shown by the two-headed arrow in FIG. 6, these first two steps may be performed in any order. It is preferred that the resin is applied to the fabric before the fabric is wrapped around the core.

As used herein, the term "resin" includes, but is not exclusively limited to, urethanes, varnishes, lacquers, epoxies, paints, and powder coatings The resin may be impregnated into the fabric 22, 122, before the fabric is placed on the core 20, or alternatively, the resin may be applied to the sleeve 24 after it is wrapped around the core.

Where appropriate, the resin may be applied to the fabric by any conventional method, such as spraying, dipping, brushing, or powder coating, after the fabric is applied to the core 20.

Then, in the method of the present invention, the resin on the fabric material 22, 122 is cured, to adhere the fabric to the core. This curing step is shown at 36 in FIG. 6.

In the curing step, the resin may be applied as a liquid and air-dried, or alternatively, may be a thermosetting resin, which is cured by heating. This curing of the resin completes the required steps, and produces a usable reinforced arrow shaft.

While not wishing to be bound by any theory, it is believed that the resin material has a tendency to strengthen, reinforce, and protect the fabric material of the sleeve.

Following the curing step, optionally, the shaft 12 may be treated to perform a smoothing operation on the external surface thereof. This may be done by hand or by an appropriate machine. Most preferably, the smoothing operation is performed by placing the cured shaft 12 in a centerless grinder, and grinding the external surface until it is smooth. This smoothing step is shown at 38 in FIG. 6.

An extra step which may be performed in the method according to the invention, which may be optionally performed subsequent to the curing step, but which is not required, is attaching one or more auxiliary accessories to the cured shaft 12, 112. These accessories may include a tip or arrow head 14, fletching 16, and a nock 18.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

Having, thus, described the invention, what is claimed is:

1. An arrow, comprising:

a hollow tubular core;

a fabric sleeve covering and affixed to the core, the core and sleeve cooperating to define an arrow shaft;

an adhesive resin material associated with the fabric sleeve; and at least one auxiliary attachment connected to said arrow shaft, said auxiliary attachment selected from the group consisting of arrow heads, fletching, and nocks.

2. An arrow, comprising:

a hollow tubular core having a first end with a first diameter, and a second end opposite the first end, the second end having a second diameter which is substantially equal to the first diameter;

a fabric sleeve covering and affixed to the core, the core and sleeve cooperating to define an arrow shaft;

an adhesive resin material associated with the fabric sleeve; and at least one auxiliary attachment connected to said arrow shaft, said auxiliary attachment selected from the group consisting of arrow heads, fletching, and nocks.

* * * * *